United States Patent [19]

Solender

[11] 4,163,407

[45] Aug. 7, 1979

[54] PROGRAMMABLE RHYTHM UNIT

[75] Inventor: Peter E. Solender, Williamsville, N.Y.

[73] Assignee: The Wurlitzer Company, DeKalb, Ill.

[21] Appl. No.: 759,822

[22] Filed: Jan. 17, 1977

[51] Int. Cl.[2] ..... G10F 1/00; G10H 1/02

[52] U.S. Cl. ..... 84/1.03; 84/1.24; 84/DIG. 12

[58] Field of Search ..... 84/1.01, 1.03, 1.17, 84/1.24, 1.26, DIG. 12

[56] References Cited

U.S. PATENT DOCUMENTS

| | | | |
|---|---|---|---|
| 3,482,027 | 12/1969 | Okamoto et al. | 84/1.03 |
| 3,549,776 | 12/1970 | Shiga | 84/1.03 |
| 3,763,305 | 10/1973 | Nakada | 84/1.03 |
| 4,058,043 | 11/1977 | Shibabara | 84/1.03 |

*Primary Examiner*—Edith S. Jackmon

*Attorney, Agent, or Firm*—Trexler, Wolters, Bushnell & Fosse, Ltd.

[57] ABSTRACT

A programmable rhythm unit is disclosed for electrically simulating sounds of a plurality of rhythm instruments being played in selected ones of a plurality of different rhythmic patterns. A variable frequency oscillator cooperates with a counter/divider and decoder circuit to provide a predetermined number of beats or pulses per measure at a tempo which may be varied by the user. Also provided is a plurality of keyed audio circuits which each produce a characteristic burst of output signals that simulate the audible output or voice of a corresponding rhythm instrument. Switching means are provided whereby the user can select any of the voices to play at any beat position. In addition an alternate beat pulse source is provided which can be selected by the switching means to play any of the voices at a particular beat position every other measure. A pseudo-random generator is also included which may be selected to play any of the voices at a random beat position in each measure.

14 Claims, 3 Drawing Figures

FREQ ADJUST.
TEMPO OSCILLATOR
MONOSTABLE
÷8 DIVIDER / COUNTER 1 OF 8 DECODER
TEMPO/8
PSEUDO-RANDOM GENERATOR AND DECODER
RANDOM BEAT
ALTERNATE BEAT
÷2 AND GATING
PLUGBOARD
KEYER DRIVERS
BASS DRUM
BRUSH
WOOD BLOCK
CYMBAL
SNARE DRUM
832 HZ OSCILLATOR
÷8
BUFFERS
104 HZ
208 HZ
832 HZ
RHYTHM VOICING CIRCUITS
AMPLIFIER
SPEAKER

PROGRAMMABLE RHYTHM UNIT

BACKGROUND OF THE INVENTION

The present invention relates to a rhythm unit for electrically simulating sounds of selected ones of a plurality of rhythm instruments being played in selected rhythmic patterns. Electronic rhythm generators of a variety of configurations are known in the art, see for example Schwartz et al U.S. Pat. No. 3,585,891. Such prior art rhythm generators have generally provided a selection of rhythm instruments or voices for the user but have been limited to a number of preset rhythmic patterns which are not alterable by the user.

The present invention is directed to a number of improvements over the prior art devices including user selection of voices, rhythmic patterns and tempos as well as alternate beat and random beat patterns which may be selectively applied to selected voices. More particularly, the invention relates to a user programmable rhythm unit which can be used in combination with an electronic musical instrument such as an electronic organ or the like to provide a rhythm accompaniment for music played thereon.

It is an object of the present invention, therefore, to provide a programmable rhythm unit.

A more specific object of the present invention is to provide a programmable rhythm unit including means for selectively altering and programming patterns produced thereby.

Another object of the present invention is to provide a programmable rhythm unit, in accordance with the foregoing objects, further including means for selectively altering and programming the rhythm instrument voices to be played in the selected rhythmic patterns.

Yet another object of the present invention is to provide a programmable rhythm unit, in accordance with the foregoing objects, further including means for repetition of a given rhythmic pattern once selected.

A further object of the present invention is to provide a programmable rhythm unit, in accordance with the foregoing objects, which further includes means for selectively altering the tempo of the selected rhythmic pattern.

A still further object of the present invention is to provide a programmable rhythm unit in accordance with the foregoing objects further including means for playing the selected rhythm voice or voices at a selected position in the rhythm pattern every other repetition thereof.

Yet a further object of the present invention is to provide a programmable rhythm unit, in accordance with the foregoing objects, further including means for playing a selected rhythm voice or voices at a random position in the rhythm pattern at each repetition thereof.

SUMMARY OF THE INVENTION

In accordance with the present invention, a variable frequency oscillator is provided whose output is adjusted according to the desired tempo of the rhythm pattern selected and programmed by the user.

The pulse output of the oscillator is fed through a divider/counter and decoder circuit to arrange the pulses in repeating measures of a predetermined number of beats to correspond with the music which the rhythm accompaniment is to be provided. Also provided is a monostable circuit for establishing a constant pulse width. A plurality of output lines from the decoder corresponding to the predetermined number of beats per measure provide one set of axes for a matrix array whose other set of axes are lines corresponding to a predetermined number of rhythm voices. Switching means are provided for the user to program the desired rhythm pattern by interconnecting selected ones of the beat pulse lines with selected ones of the rhythm voice lines. A psuedo-random generator and decoder is also provided whose output comprises an additional line in the matrix array in parallel with the beat pulse lines, to be selectively programmed by the user in the same manner. An alternate beat circuit is also provided which may be selectively programmed by the user to connect the beat pulse lines of the array with selected ones of the rhythm voice lines at alternate measures. The resultant programmed rhythm pattern output on the rhythm voicing line is fed to keyer driver circuits which provide the desired rhythm pattern pulses to drive the individual rhythm voicing circuits.

The audio circuit includes a master audio oscillator and a frequency divider for deriving lower audio frequencies therefrom, which provides a portion of the audio input for the rhythm voicing circuits.

The rhythm voicing circuits include a group of audio filter circuits which, when energized by an appropriate audio frequency such as the oscillator and divider output described above or a plurality of audio and noise generators provided therefor, simulate the output of a corresponding rhythm instrument, and a group of audio keying circuits for gating the audio signals into the audio filter circuits in synchronism with the rhythm pulse output pattern from the rhythm pattern circuitry described above. The output of the rhythm voicing circuits is then fed to a conventional audio amplifier which drives a conventional audio speaker, which may be either an integral part of the programmable rhythm unit or a part of the electronic musical instrument with which the unit is being used.

The structure and function of the rhythm voicing circuit of the present invention are similar to that disclosed in Schwartz et al U.S. Pat. No. 3,585,891, mentioned above, issued June 22, 1971 and assigned to the assignee of the present invention, and need not be described in detail herein.

The foregoing, as well as other objects and advantages of the present invention will become apparent from the following detailed description taken together with the attached drawings wherein like reference numerals are intended to designate similar parts and components throughout.

DETAILED DESCRIPTION

Figure 1:
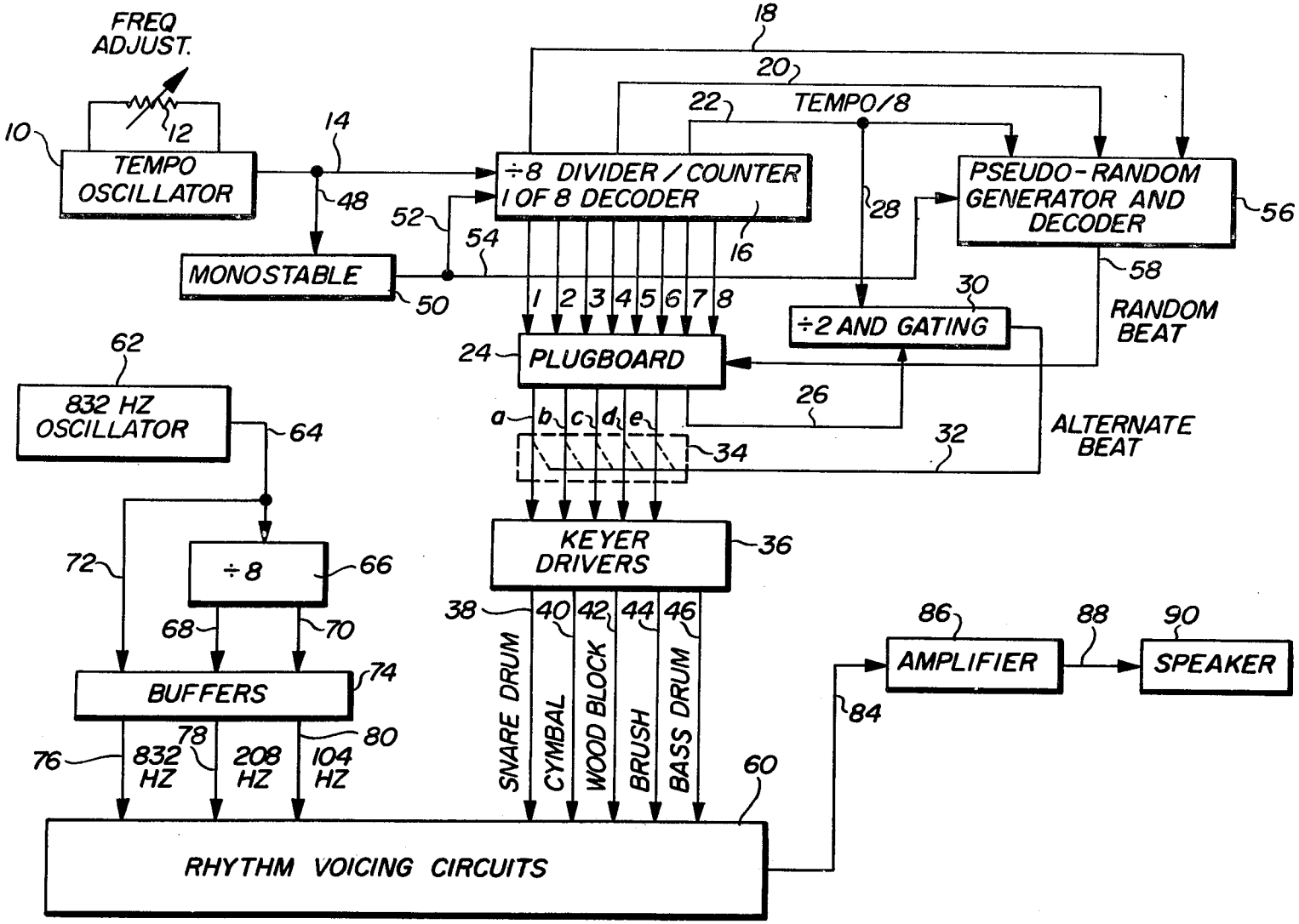
FIG. 1 is a block diagrammatic illustration of a programmable rhythm unit incorporating features of the present invention.

Referring specifically to FIG. 1, the major components of a programmable rhythm unit in accordance with the present invention are shown in block diagramatic form. A tempo oscillator 10 provides a continuous chain of pulses at its output and includes a variable resistor 12 to adjust the frequency of the output in accordance with a desired rhythm tempo. The output of the tempo oscillator 10 on line 14 is connected to an input of a divider/counter and circuit 16. A monostable circuit 50 is provided with an input connected by line 48 to the output on line 14 of the tempo oscillator 10, and with an output on line 54 connected by line 52 to another input of the divider/counter and decoder circuits 16. The monostable circuit 50 establishes a constant pulse width for the output of the decoder portion of the divider/counter and decoder circuits 16. The divider/counter and decoder circuits 16 function to count a predetermined number of pulses from the tempo oscillator 10, to divide the pulses into equal groups corresponding to musical measures, and to provide a predetermined number of pulses per group corresponding to a number of beats per measure of music. The pulses or beats per measure so established are sequentially switched by the decoder circuitry to beat or pulse output lines 1 through 8, each line carrying one beat or pulse per group or measure. It is to be understood that, in accordance with the present invention, divider/counter and decoder circuitry 16 may be provided to establish any desired number of beats per measure at its output. The disclosure will be facilitated, however, by using a specific example a divide by eight divider/counter and one of eight decoder having an output of eight beats per measure. This example is provided for purposes of illustration only and is not intended to so limit the invention.

The beat output lines 1 through 8 of the decoder are fed into a user programmable circuit such as plugboard 24 where the beat output may be selectively transferred, switched or programmed into a plurality of lines such as a, b, c, d and e, which correspond to inputs for a plurality of rhythm voices. Again, according to the present invention any desired number of rhythm voices may be provided. The disclosure will be facilitated, however, by illustrating and describing five rhythm voices; snare drum, cymbal, wood block, brush and bass drum. These five voices and their identities are given only as an example to facilitate the description and drawings and are not intended to so limit the invention.

The selective coupling of beat pulse lines 1 through 8 with rhythm voice lines a through e sets in or programs a rhythm pattern comprising a plurality of output pulses on a plurality of lines for keying the rhythm voices on selected beats according to the programming or interconnections of the array or plug board 24. The programmed rhythm pattern on lines a,b,c,d and e is then fed to keyer driver circuits 36 which provide corresponding pulses on lines 38, 40, 42, 44 and 46 to drive keyers for the rhythm voices included in the rhythm voicing circuits 60 connected thereto.

Audio input signals for the rhythm voicing circuit 60 are generated by a circuit comprising oscillator 62, dividers 66 and buffers 74. In the illustrated embodiment oscillator 62 is an 832 Hertz oscillator whose output on line 64 is connected to the input of a divide by eight divider 66 and by lines 72 to the input of buffer 74. Then divide by eight divider 66 is provided with an output line 70 for a 104 Hertz (divided by eight) frequency and output line 68 for a 208 Hertz (divided by four) frequency. The outputs of lines 68, 70 and 72 are connected to buffer circuits 74 which have outputs on lines 76, 78 and 80 of 832 Hertz, 208 Hertz and 104 Hertz, respectively, for providing suitable audio input signals to the rhythm voicing circuits 60. It will be noted that the frequencies and ratios therebetween chosen are for purposes of illustrating a preferred embodiment only, and are not intended to so limit the invention thereto.

The rhythm voicing circuits include means for gating audio signals from the audio circuitry above described, as well as other audio generators which may be provided in accordance with the present invention, into audio circuits for simulating the output of corresponding rhythm instruments. This gating through of audio signals is performed according to the programmed rhythm pattern as controlled by the inputs on lines 38, 40, 42, 44 and 46 of the rhythm voicing circuits 60. Briefly, the rhythm voicing circuits 60 include a plurality of audio and noise generators, keyer circuits and filter circuits to produce desired rhythm voices in accordance with the programmed rhythm pattern. The structure and function of the generator, keyer and filter circuits of the present invention are substantially the same as that disclosed in Schwartz et al U.S. Pat. No. 3,585,891 mentioned above and assigned to the assignee of the present invention, and need not be described in detail herein. The output of the rhythm voicing circuits, then, corresponds to the programmed rhythm pattern and is fed on output line 84 to amplifier 86 and on amplifier output line 88 to audio speaker or speakers 90. Audio amplifier 86 and audio speaker or speakers 90 may be of any suitable known construction and need not be described in detail herein. The amplifier 86 and speaker or speakers 90 may be provided as part of the programmable rhythm unit or may be a part of an electronic musical instrument with which the unit is being used.

Output lines 18, 20 and 22 of divider/counter 16 are fed into a pseudo random generator and decoder 56 to provide random beat output pulses on line 58.

The monostable circuit 50 is also connected by line 54 to the pseudo random generator and decoder to provide a constant pulse width for the output thereof on line 58. The random beat pulses on line 58 are fed to the plug board 24 where they provide one pulse per measure in a similar fashion as lines 1 through 8 at a beat position chosen randomly therefrom. The rhythm voice input lines a, b, c, d and e may be programmed or connected as desired to the random beat line 58 in the same manner as to lines 1 through 8, as will be described in detail below.

Output line 22 of the divider/counter provides a signal or pulse corresponding to the last beat per measure, which in the illustrated example is the eighth beat per measure connected by line 28 to the input of alternate beat circuit 30. The alternate beat circuitry comprises a divide by two circuit and appropriate gate for providing an output pulse on output line 32 for every other measure. The beat position at which this output pulse on line 32 is provided is determined by the connection of input line 26 to selected ones of lines 1 through 8 on the plug board 24, as will be described in detail below. The alternate beat output signal on line 32 is fed to a plurality of switches 34 which may be separate or a part of plug board 24 for selectively providing an alternate beat pulse on lines a, b, c, d and e. Thus, the inputs 38, 40, 42, 44 and 46 to the rhythm voicing circuit 60 may also be programmed to include random beat or beats in alternate measures as provided by the above described circuitry.

Figure 2:
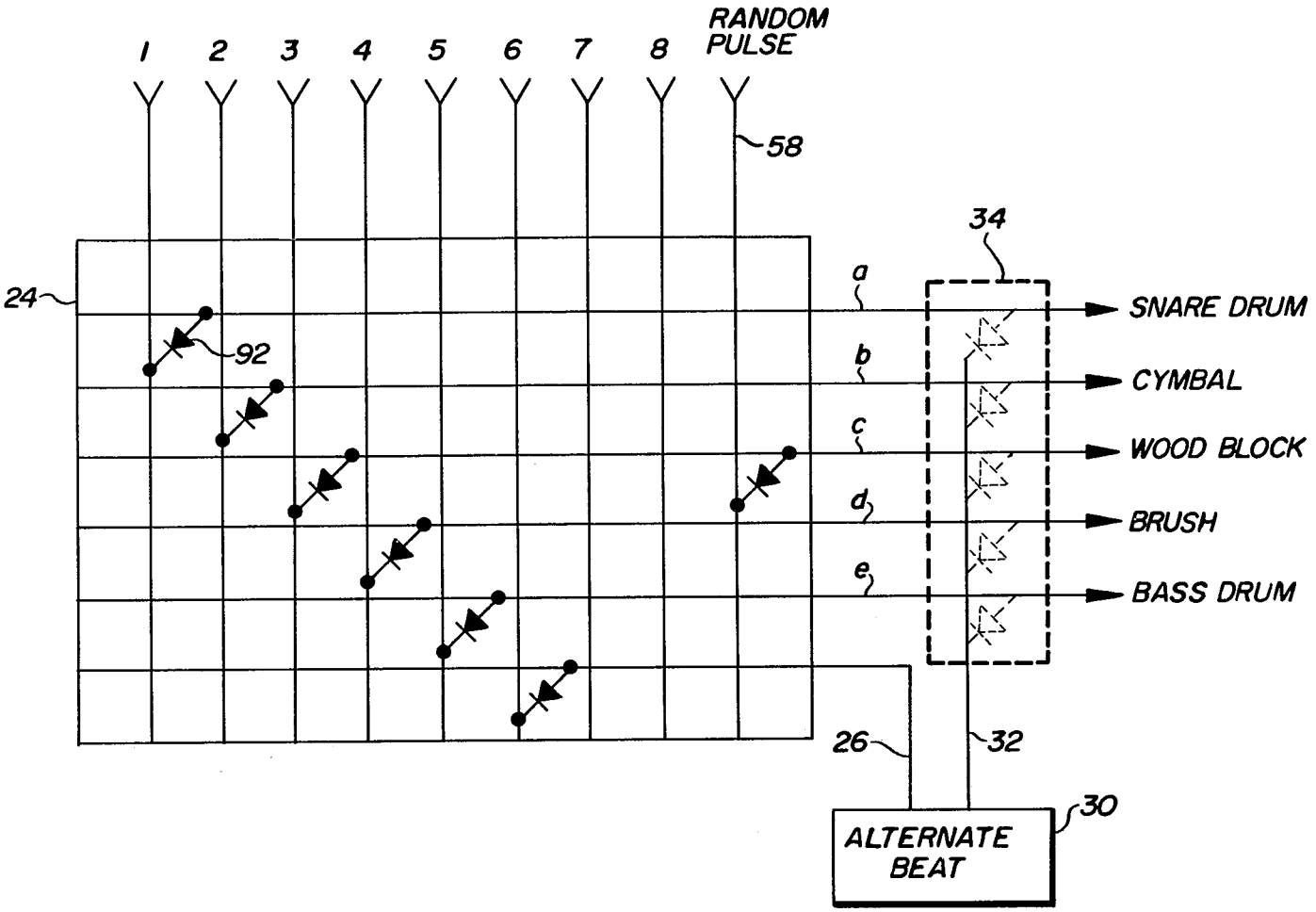
FIG. 2 is a circuit diagram of a programmable matrix array incorporating features of the present invention.

Referring now to FIG. 2, an embodiment of a matrix array programming circuit such as plug board 24 is illustrated in detail. One set of axes in matrix array 24 is provided by beat pulse output lines 1 through 8 and random pulse output line 58. The other set of axes in matrix array 24 is provided by rhythm voice input lines a through e and alternate beat input line 26. A plurality of connecting means is provided to interconnect selected ones of the lines 1 through 8 and 58 with selected ones of the lines a through e and 26 such as diode plugs 92. In the example illustrated in FIG. 2, line 1 is connected to line a, the snare drum input, to provide an input pulse thereto on the first beat of each measure. Similarly, line 2 is connected to line b, the cymbal input, line 3 to wood block input line c, line 4 to brush input line d and line 5 to bass drum input line e to provide input pulses to activate these rhythm sounds on the second, third, fourth, and fifth beats of each measure, respectively. Line number 6, in the present example is connected to input line 26 of the alternate beat circuitry 30 which provides an output pulse on line 32, then, on the sixth beat of alternate measures. The alternate beat output on line 32 is connected to a plurality of selectively closeable switches 34 which may be selectively connected to rhythm voice input lines a through e to provide desired rhythm voices at the chosen beat position an alternate measures. The random pulse output line 58, in the present example, in connected to output line c, the wood block voice input to provide a wood block voice at a random beat position in each measure.

Thus, the rhythm unit may be programmed by use of the matrix array plug board 24 and switches 34 in the manner desired by the user. A sufficient number of diode plugs 92 are provided for the user to connect any of the lines 1–8 to any of the lines a–e. Thus, any of the lines 1–8 may be connected to one of the lines a–e, more than one of the lines a–e, all of the lines a–e or none of the lines a–e. In the same manner, diode plugs 92 are provided to connect the random pulse line 58 to one, more than one, all or none of the lines a–e as desired. In the cicuit shown switches 34 may be selectively closed to connect alternate beat line 32 to any one, and only one of the lines a–e. With the addition of diodes (shown as dotted lines) in series with the switches 34, any combination of switch connections may be used, to provide fully selectable, alternate beat voice actuation. In this manner, the user may then program any desired pattern of beats, including random pulse beats and alternate beats on to the rhythm voice lines a–e to create a desired rhythm pattern.

The matrix array plug board 24 and switches 34 may be located adjacent to one another on a control panel accessible to the operator. The example of a plug board with diode plug connectors for programming the matrix array 24 is used only to facilitate the description of the invention herein, and is not intended to limit the invention thereto. It will be obvious to one skilled in the art that a wide variety of devices and embodiments may be used to provide the function of programming the array and are therefore functional equivalents of the illustrated embodiment which the present invention is intended to encompass.

Figure 3:
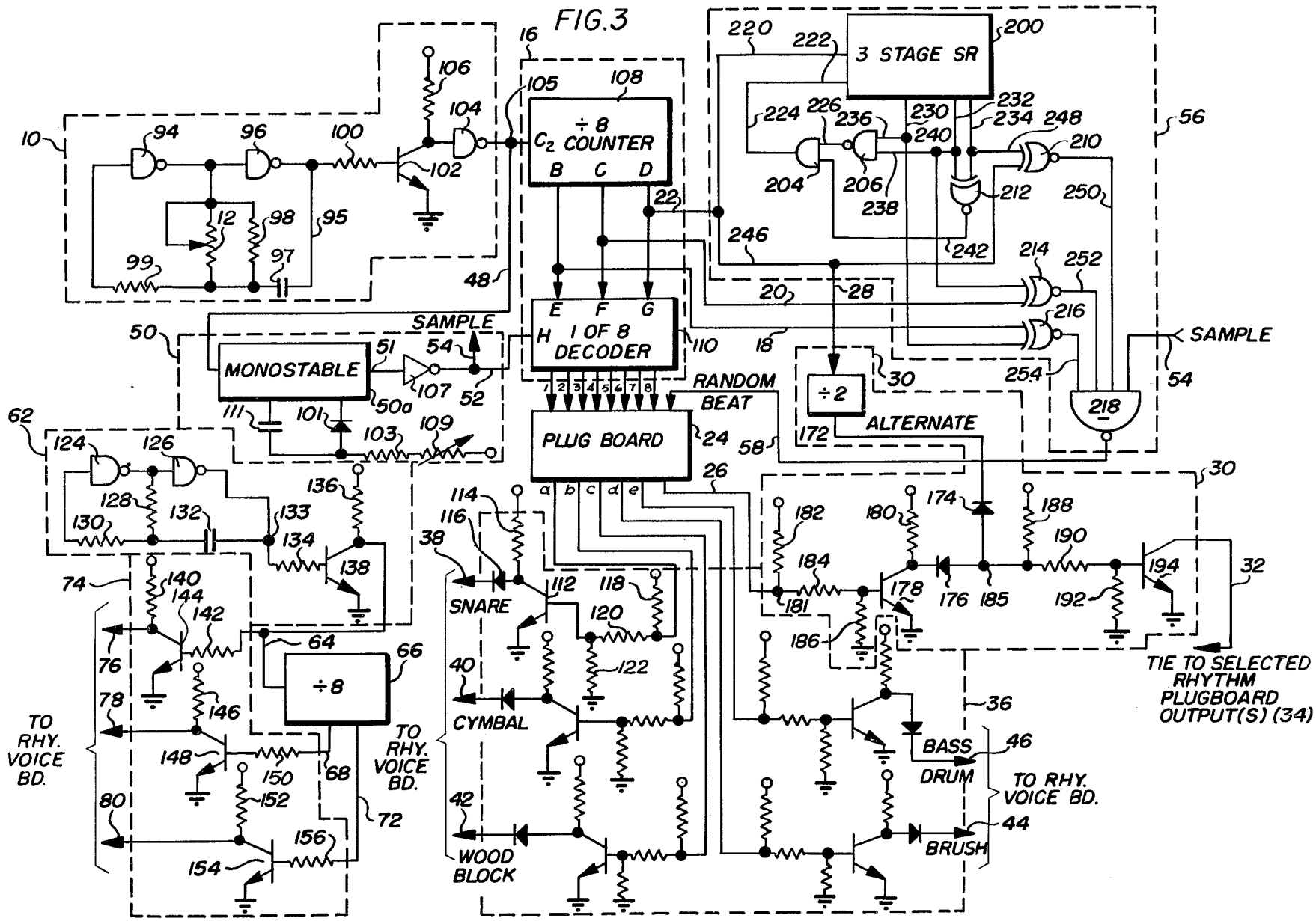
FIG. 3 is a circuit diagram of portions of a programmable rhythm unit incorporating features of the present invention.

Referring now to FIG. 3, portions of the circuitry of FIG. 1 are illustrated in greater detail. Variable oscillator 10 comprises gates 94 and 96 which may be, for example, CMOS type 4009 manufactured by RCA. These gates are connected in series with feedback line 95 connecting the output of gate 96 to a capacitor 97. The opposite side of capacitor 97 is connected to resistor 98, variable resistor 12, and resistor 99. Variable resistor 12 and resistor 98 are connected in parallel with each other and are also tied to gate 94 output. Resistor 99 is part of the series feedback circuit to the input of gate 94. An output stage is provided for the oscillator, comprising resistor 100 in series with the output of gate 96, transistor 102 which has its base connected to the opposite end of the resistor 100, its collector connected to a positive power supply through resistor 106, and its emitter tied to ground. The output stage also includes a gate 104 tied to the collector of transistor 102. Gate 104 may be, for example, a type 7404 manufactured by Texas Instruments. This circuitry provides a suitable output signal to drive the following circuitry.

The oscillator output at terminal 105 is connected to an input of a divide by eight counter/divider 108 which provides a repeating eight count binary code output at its output terminals B, C and D. Counter 108 may be, for example, the divide 8 portion of divide 16 circuit type 7493 manufactured by Texas Instruments. The binary code eight count output at terminals B, C and D is connected to input terminals E, F and G, respectively of a one of eight decoder circuit 110 which provides corresponding output pulses in sequence on its outputs 1 through 8 for each eight count cycle of the divider/-counter 108. Decoder 110 may be, for example, a type 7442 manufactured by Texas Instruments. Monostable circuit 50 includes a monostable integrated circuit 50*a* which may be, for example, a type 74123 manufactured by Texas Instruments. The monostable 50*a* input is connected by line 48 to oscillator output 105. The monostable 50A provides a pulse output of constant width at its output terminal 51 as determined by a timing circuit connected thereto comprising capacitor 111, diode 101, resistor 103 and variable resistor 109. The constant pulse width output of the monostable 50A at terminal 51 is fed through inverter 107 connected in series therewith to provide a suitable signal to the input of the circuits connected thereto by lines 52 and 54. Line 52 connects the output of the monostable to input terminal H of the one of eight decoder 110, to maintain a controllable constant pulse width of the sequential pulses at the outputs 1 through 8 thereof.

The outputs 1 through 8 of the one of eight decoder 110 are connected to the inputs of the matrix array or plug board 24 wherein they are programmed to the lines a,b,c, d and e as explained above in the reference to FIG. 2. These outputs are connected to the keyer driver circuits 36 each line having its own associated keyer driver circuit whose output is connected to the rhythm voicing circuits as shown by FIG. 1. Line a, for example, is connected to a keyer driver circuit comprising resistors 114, 118, 120, and 122, transistor 112 and diode 116. Line a is connected to one end of resistor 120 whose other end is connected to the base of transistor 112. Resistor 118 is connected from a positive supply to the junction of line a and resistor 120, and resistor 122 is connected between ground and the base of transistor 112. Transistor 112 has resistor 114 connected between a positive power supply and its collector terminal and has its emitter terminal tied to ground. Diode 116 is connected in series with the collector of transistor 112, and the output of the keyer driver circuit is at line 38 which is connected in series with diode 116. The signal on output line 38 then corresponds to the beat pattern programmed into line a as described in the reference to FIG. 2 above. Lines b, c, d and e are also each connected to a keyer driver circuit of the same configuration and function as that described connected to line a.

Referring to the top right hand portion of FIG. 3, the pseudo-random beat function is provided by the circuitry of block 56. A three stage shift register 200, for example, of type 7495 manufactured by Texas Instruments is provided with a feedback network as follows. Lines 232 and 234 which are 2nd and 3rd storage outputs from the shift register 200 are connected to opposite inputs of a two input exclusive NOR gate 212, for example, of the type 8242 manufactured by Signetics Corporation, whose output on line 242 is connected to one input of two input AND gate 204. Line 230 connects shift register 200 first stage output with one input on line 236 of two input NAND gate 206, for example, of the type 7400 manufactured by Texas Instruments. The other NAND gate 206 input on line 238 is connected to the aforementioned line 232. NAND gate 206 has its output on line 226 connected to the other input of AND gate 204, for example, of the type 7408 manufactured by Texas Instruments which then has its output on line 224 connected back to the shift register 200 first stage input completing the feedback loop.

This shift register circuit with feedback is a form of ring counter circuit that in particular is called an M-sequence generator. The M-sequence generator type of circuit is generally known as a class of counter circuits that may be implemented in various sizes according to the number of count states desired, thus the M-sequence. The count states generally do not follow any standard code progression such as Gray code or Binary coded decimal, etc., but do, however, repeat in a cyclic fashion. The number of count states available is equal to at most $2^m-1$, where M is the number of shift register states.

The output lines 230, 232, 234 will sequence through a pseudo-random cycle of states that in this particular configuration is $2^3-1=7$. The cycle of states is shown in the table below, assuming that register initially is in the 001 state. Note that the all 1's state is not used and is inhibited from occurrence by Gate 206. This combination is a lock-up condition that is common with this type of counter and must be avoided. With this exception, the counter is sequential from any state to the next.

TABLE

| Clock Pulse | Output Line 230 | Output Line 232 | Output Line 23 |
|---|---|---|---|
| 1 | 0 | 0 | 0 |
| 2 | 1 | 0 | 0 |
| 3 | 1 | 1 | 0 |
| 4 | 0 | 1 | 1 |
| 5 | 1 | 0 | 1 |
| 6 | 0 | 1 | 0 |
| 7 | 0 | 0 | 1 |

The M-sequence generator is driven by the D output of the divide by eight counter/divider 108, which is connected by line 22 and line 220 to the clock input of the shift register 200. Thus, every time the eighth count is reached the M-sequence generator advances by one count to its next state. The M-sequence generator has outputs as follows: line 234 at one output of the shift register 200 is connected by line 248 to one input of a two input exclusive NOR gate 210; line 232 at a second output of the shift register 200 is connected by line 240 to one input of a two input exclusive NOR gate 214, and line 230 at a third output of the shift register 200 is connected to one input of a two input exclusive NOR 216. The state of the M-sequence generator is then compared at gates 210, 214 and 216 with the count of the divide by eight counter/divider 108 which is fed to the other inputs of the three gates as follows: output D is connected by line 22 and line 246 to the other input of gate 210, output C is connected by line 20 to the other input of gate 214, and output B is connected by line 18 to the other input of gate 216. Gates 210, 214 and 216 have their respective outputs connected by lines 250, 252 and 254 to three inputs of a four input NAND gate 218 for example, of the type 7440 manufactured by Texas Instruments which has its fourth input connected by line 54 to the output of the monostable circuit 50. Thus, when the count on the divide by eight counter/-divider 108 matches the M-sequence state a pulse is put out on the random beat line 58 connected to the output of gate 218 of the same pulse width as the pulse outputs on lines 1 through 8 as determined by the monostable circuit 50. Line 58 is connected to the matrix array or plug board 24 for selective programming to the rhythm voice lines as described in the reference to FIG. 2.

The alternate beat is produced by feeding the divide by eight counter/divider 108 output at terminal D through lines 22, 246 and 28 to a divide by two integrated circuit 172. This circuit 172 is a J-K flip-flop of the type 7473 manufactured by Texas Instruments, for example. Line 26 carried the beat or pulse from the plug board 24 at which the alternate beat function has been programmed as described above in reference to FIG. 2 to input terminal 181 of the alternate beat circuit 30. Terminal 181 is the input of a driver stage comprising resistor 180, 182, 184 and 186 and transistor 178. The input at terminal 181 is connected to one end of resistor 184 which is connected in series with the base of transistor 178. Resistor 182 is connected between a positive power supply and input terminal 181 and resistor 186 is connected between the base of transistor 178 and ground. Resistor 180 is connected between a positive power supply and the collector of transistor 178 and transistor 178 has its emitter connected to ground. The programmed pulse or beat output at the collector of transistor 178 is connected to terminal 185 through diode 176, while the output of the divide by two circuit 172 is also connected to terminal 185 through diode 174. Thus, diodes 174 and 176 form an AND circuit for the aforementioned two outputs, and therefore the resultant output at terminal 185 is a beat pulse at the programmed beat position on alternate measure or sequences through the beat positions. The signal at terminal 185 is then fed through a driver stage comprising resistors 188, 190 and 192 and transistor 194. Resistor 190 is connected between terminal 185 and the base of transistor 194, resistor 188 is connected between a positive power supply and terminal 185 and resistor 192 is connected between the base of transistor 194 and ground. Transistor 194 has its emitter terminal connected to ground and the driver stage output which is the resultant output of the alternate beat circuit 30 is fed on line 32 to selected plug board 24 outputs as described in the reference to FIG. 2.

The audio input to the rhythm voicing boards is provided in part, as described above in the reference to FIG. 1 and 832 hertz oscillator 62 in conjunction with a divider and buffer circuit. Oscillator 62 comprises gates 124 and 126 which may be CMOS type 4009 manufactured by RCA, for example, connected in series having a feedback loop comprising resistor 130 and capacitor 132 in series connected between the output of gate 126 and the input 124 and resistor 128 having one end connected to the junction of resistor 130 and capacitor 132 and its other end connected to the junction of gates 124 and 126. The output of the oscillator at terminal 133 is connected to a driver or buffer stage comprising transistor 138 which is provided with a resistor 134 connected between its base input and terminal 133, a resistor 136 connected between its collector terminal and a positive power supply and its emitter connected to ground. The collector output of transistor 138 is fed on line 64 to an input of a divide by eight integrated circuit 66. This circuit 66 may be the divide by eight portion of a divide by sixteen circuit 7493 manufactured by Texas Instruments, for example. The divide by eight circuit 66 has a divided by four output on line 68 and divided by eight output on line 72. The divide by four output on line 68 is connected to a buffer circuit comprising transistor 148 which is provided with a resistor 150 connecting its base to line 68, resistor 146 connected between its collector terminal and a positive power supply and has its emitter tied to ground. The output of the buffer circuit is at the collector terminal of transistor 148 and is tied to line 78 which runs to the rhythm voicing circuits as already described in the reference to FIG. 1. The 832 hertz oscillator output on line 64 is also connected to a buffer circuit comprising transistor 144 and resistors 140 and 142 which is identical in its structure and function to the previously described buffer circuits and has its corresponding output on line 76. The divide by eight output of the divide by eight circuit 66 on line 72 is connected to a buffer circuit comprising transistor 154 and resistors 152 and 156 which is identical in its structure and function to the buffer circuits already described and has its corresponding output on line 80.

While a preferred embodiment of the invention has been shown and described herein, it should be understood, of course, that the invention is not limited thereto since many modifications may be made thereto without departing from the spirit and scope of the invention as set forth in the appended claims.

The invention is claimed as follows:

1. A programmable rhythm unit comprising: oscillator means for providing a continuous chain of pulses at a predetermined frequency, circuit means connected to said oscillator means for sequentially and repeatedly arranging said pulses in groups of an equal and predetermined number of pulses corresponding to repeating measures having an equal and predetermined number of beats per measure, said circuit means including a plurality of output lines for receiving said pulses to establish fixed beat positions in each measure, a plurality of rhythm voice input lines, a programmable array means for selectively transferring said pulse from selected ones of said output lines to selected ones of said plurality of rhythm voice input lines, pseudo-random pulse means connected to said circuit means and to said programmable array means for providing a random pulse at a predetermined beat position in each group corresponding to a random beat per measure, said programmable array means including means selectively to transfer said random beat to selected ones of said rhythm voice input lines, to establish a programmed rhythm pattern at said rhythm voice input lines, keyer driver circuit means connected to said rhythm voice input lines, audio signal generator means, and rhythm voicing circuit means connected to said keyer driver circuit means and to said audio signal generator means for simulating the audio output of a plurality of rhythm instruments in accordance with said programmed rhythm pattern.

2. The programmable rhythm unit of claim 1 further including audio amplifier means connected to said rhythm voicing circuit means and speaker means connected to said amplifier means for audio reproduction of said simulated rhythm instruments.

3. The programmable rhythm unit of claim 1 wherein said circuit means comprises a divider/counter circuit coupled to said oscillator means and a decoder circuit connected between said divider/counter circuit and said plurality of output lines.

4. The programmable rhythm unit of claim 1 wherein said programmable array means comprises a plug board having diode plugs selectively connectable between said output lines and said input lines.

5. The programmable rhythm unit of claim 4 further including alternate best circuit means connected to said divider/counter circuit and selectively connectable in circuit with said programmable array means for transferring said pulses only in alternate ones of said groups from selected ones of said output lines to selected ones of said input lines, said transferred pulses corresponding to beats at selected beat positions in alternating measures.

6. The programmable rhythm unit of claim 1 further including strobing means connected to said circuit means for establishing a constant pulse width for said pulses carried on said output lines, and connected to said pseudo-random pulse means for establishing a constant pulse width for said random pulses.

7. The programmable rhythm unit of claim 1 wherein said oscillator means includes means adjustable for varying said predetermined frequency in accordance with a desired tempo.

8. A programmable rhythm unit for use with an electronic musical instrument said instrument including an audio amplifier and at least one audio speaker connected thereto, said rhythm unit comprising: oscillator means for providing a continuous chain of pulses at a predetermined frequency, circuit including a plurality of output lines and connected to said oscillator means for sequentially and repeatedly delivering said pulses to said output lines to correspond to repeating measures having a predetermined number of beats per measure, the pulses delivered to each of said output lines corresponding to fixed beat positions in each measure, a plurality of rhythm voice input lines, programmable array means for selectively transferring said pulses from selected ones of said output lines to selected ones of said rhythm voice input lines to establish a programmed rhythm pattern, keyer driver circuit means connected to said rhythm voice input lines, rhythm voicing circuit means including audio signal generator means and connected to said keyer driver circuit means and to said audio amplifier for simulating the audio output of a plurality of rhythm instruments in accordance with said programmed rhythm pattern and alternate beat circuit means connected to said circuit means and having an alternate beat input line selectively connectable in said programmable array means with selected ones of said output lines and having an alternate beat output line and means for selectively connecting said alternate beat output line with selected ones of said rhythm voice input lines, said alternate beat circuit means transferring said pulses only in alternate ones of said repeating measures from said selected ones of said output lines to said selected ones of said rhythm voice input lines to correspond to beats at selected beat positions in alternate measures.

9. The programmable rhythm unit of claim 9 wherein said circuit means comprises a divider/counter circuit coupled to said oscillator means and a decoder circuit connected between said divider/counter circuit and said output lines.

10. The programmable rhythm unit of claim 8 wherein said programmable array means comprises a plug board having diode plugs selectively connectable between said output lines and said input lines.

11. The programmable rhythm unit of claim 9 further including pseudo-random pulse means connected to said divider/counter circuit and to said programmable array means for producing random pulses in synchronization with pulses chosen at random from each group to correspond to a beat at a random beat position in each measure, said array means including means selectively to transfer said random pulses to selected ones of said rhythm voice input lines.

12. The programmable rhythm unit of claim 11 further including means connected to said decoder circuit for establishing a constant pulse width for said pulses delivered to said output lines, and connected to said pseudo-random pulse means to establish a constant width for said random pulses.

13. The programmable rhythm unit of claim 8 wherein said oscillator means includes means adjustable for varying said predetermined frequency in accordance with a desired rhythm tempo.

14. A programmable rhythm unit comprising: oscillator means for providing a continuous chain of pulses at a predetermined frequency, circuit means connected to said oscillator means for arranging said pulses in equal groups corresponding to repeating measures of a predetermined number of beats, a plurality of output lines connected to said circuit means, said circuit means further including means for sequentially switching the pulses in each group to said output lines to correspond to fixed beat positions in each measure, a plurality of rhythm voice input lines, programmable array means for selectively transferring said pulses from selected ones of said output lines to selected ones of said input lines to establish a programmed rhythm pattern, and pseudo-random pulse producing means connected to said circuit means for producing a random pulse at a randomly selected beat position in each measure, said programmable array means further including means for transferring said random pulse to selected ones of said rhythm voice input lines.

* * * * *

UNITED STATES PATENT AND TRADEMARK OFFICE

CERTIFICATE OF CORRECTION

PATENT NO. : 4,163,407

DATED : August 7, 1979

INVENTOR(S) : Peter E. Solender

It is certified that error appears in the above-identified patent and that said Letters Patent are hereby corrected as shown below:

Column 3, line 5, after "and" insert --decoder--;

Column 3, line 27, after "using" insert --as--;

Column 3, line 62, change "Then" to --The--;

Column 6, line 47, change "wherein" to --where--;

Column 6, line 57, after "positive" insert --power--;

Column 8, line 62, change "and" to --by--;

Column 10, line 16, change "best" to --beat--.

Signed and Sealed this

*Twenty-eighth* Day of *October 1980*

[SEAL]

*Attest:*

SIDNEY A. DIAMOND

*Attesting Officer*

*Commissioner of Patents and Trademarks*